US008464389B2

(12) United States Patent
Jiang et al.

(10) Patent No.: US 8,464,389 B2
(45) Date of Patent: Jun. 18, 2013

(54) CLEANING DEVICE HAVING MULTIPLE CLEANING SURFACES

(75) Inventors: Weilai Jiang, Shanghai (CN); Feng Zeng, Shanghai (CN)

(73) Assignee: 3M Innovative Properties Company, Saint Paul, MN (US)

( * ) Notice: Subject to any disclaimer, the term of this patent is extended or adjusted under 35 U.S.C. 154(b) by 625 days.

(21) Appl. No.: 12/294,440

(22) PCT Filed: Mar. 28, 2007

(86) PCT No.: PCT/US2007/065314

§ 371 (c)(1),
(2), (4) Date: Aug. 9, 2010

(87) PCT Pub. No.: WO2007/115026

PCT Pub. Date: Oct. 11, 2007

(65) Prior Publication Data

US 2010/0293732 A1 Nov. 25, 2010

(30) Foreign Application Priority Data

Mar. 31, 2006 (CN) ..... 2006 1 0073374

(51) Int. Cl.
*A47L 13/12* (2006.01)
*A47L 13/20* (2006.01)

(52) U.S. Cl.
USPC ..... 15/118; 15/228

(58) Field of Classification Search
USPC ..... 15/118, 228
See application file for complete search history.

(56) References Cited

U.S. PATENT DOCUMENTS

| | | | |
|---|---|---|---|
| 3,656,202 | A | 4/1972 | Paton |
| 4,114,223 | A | 9/1978 | Buchanan |
| 4,349,933 | A | 9/1982 | Thompson |
| 5,280,664 | A | 1/1994 | Lin |
| 5,596,787 | A | 1/1997 | Stevens |

(Continued)

FOREIGN PATENT DOCUMENTS

| | | | |
|---|---|---|---|
| CN | 2549888 | Y | 5/2003 |
| CN | 2572917 | Y | 9/2003 |

(Continued)

OTHER PUBLICATIONS

Supplementary European Search Report, EP 07 75 9533, Mar. 8, 2011, 7 pages.

(Continued)

*Primary Examiner* — Randall Chin
(74) *Attorney, Agent, or Firm* — Trisha D. Adamson

(57) ABSTRACT

The cleaning device of the present invention comprises: a cleaning portion, the cleaning portion is provided with a cleaning surface and an opposite surface opposed to the cleaning surface; a supporting arm (4); and a pivoting mechanism (5) for pivotably supporting the supporting arm (4) on the opposite surface. The cleaning surface (3) of the cleaning portion includes a first cleaning material surface (3*a*) and a second cleaning material surface (3*b*), the first cleaning material surface (3*a*) and the second cleaning material surface (3*b*) come into contact with the surfaces to be cleaned, respectively. When any one of the first cleaning material surface (3*a*) and the second cleaning material surface (3*b*) comes into contact with the surface to be cleaned, the other cleaning material surface has an angle (α) from 90 degrees to 180 degrees with respect to the surface to be cleaned.

12 Claims, 3 Drawing Sheets

U.S. PATENT DOCUMENTS

| | | | | |
|---|---|---|---|---|
| 6,591,442 | B2 | 7/2003 | Kaminstein | |
| 6,976,282 | B2 | 12/2005 | Sie | |
| 7,047,586 | B2 | 5/2006 | Shimada | |
| 7,380,306 | B2 * | 6/2008 | Broman | 15/118 |
| 2002/0174502 | A1 | 11/2002 | Cioci | |
| 2004/0019995 | A1 | 2/2004 | Kowalski | |
| 2004/0226123 | A1 | 11/2004 | Policicchio | |

FOREIGN PATENT DOCUMENTS

| | | | |
|---|---|---|---|
| CN | 2678552 | Y | 2/2005 |
| DE | 60110116 | T2 | 4/2006 |
| EP | 1345523 | B1 | 4/2005 |
| EP | 1810662 | | 7/2007 |
| GB | 2 233 882 | A | 1/1991 |
| JP | 09-164110 | A | 6/1997 |
| JP | 9-173261 | | 7/1997 |
| JP | 10-286208 | | 10/1998 |
| JP | 10-290770 | | 11/1998 |
| JP | 11-128156 | A | 5/1999 |
| JP | 11-137503 | | 5/1999 |
| JP | 2002-238824 | A | 8/2002 |
| JP | 2004-201716 | A | 7/2004 |
| TW | 588639 | U | 5/2005 |
| WO | WO 00/27271 | | 5/2000 |
| WO | WO 02/43555 | A1 | 6/2002 |
| WO | WO 2004/080265 | A2 | 9/2004 |
| WO | WO 2005/013791 | A1 | 2/2005 |
| WO | WO 2006/002654 | A1 | 1/2006 |

OTHER PUBLICATIONS

International Search Report, PCT/US01/43514, mailed Apr. 18, 2002, 3 pages.

Written Opinion, PCT/US01/43514, mailed Sep. 27, 2002, 6 pages.

* cited by examiner

CLEANING DEVICE HAVING MULTIPLE CLEANING SURFACES

CROSS REFERENCE TO RELATED APPLICATIONS

This application is a national stage filing under 35 U.S.C. 371 of PCT/US2007/065314, filed Mar. 28, 2007, which claims priority to CN Application No. 10073374.1, filed Mar. 31, 2006, the disclosures of which are incorporated by reference in their entirety herein.

FIELD OF INVENTION

The present invention relates to a cleaning device, more particular, to a cleaning device having multiple cleaning surfaces.

BACKGROUND OF INVENTION

In the present field of household cleaning appliances, floor mop is increasingly and broadly welcome by urban users thanks to its feature of aesthetic appearance. At present, floor mop in the market is usually composed of a supporting plate, a supporting arm pivotably secured to the center of the supporting plate, and a mop cloth clamped on both sides of the supporting plate. The mop cloth is mounted to the bottom portion of the mop supporting plate by means of a variety of attachment mechanisms, such as nylon hook-and-loop fastener, snap fastener etc., and the supporting arm is connected to the top portion of the supporting plate. Since floor mop has advantages of large cleaning area, high cleaning efficiency and convenience to disassemble mop cloth for washing, it is an appropriate substitution in place of conventional mop.

However, in application of the floor mop described above there are many problems, in which the most prominent one is arisen from the fact that the floor mop has only one cleaning surface, and the material used for mop cloth must meet various environments in design, hence selection of material is limited. For example, stubborn stains and smudges on floor can hardly be removed if the mop cloth contains a conventional cleaning material. However, if the mop cloth contains an abrasive material capable of grinding away stains, the remaining part of floor without stains may be scraped and harmed. Therefore, a conventional floor mop cannot be used for cleaning of ordinary floor and at same time for floor with stubborn stains.

Moreover, a conventional floor mop further has the following drawbacks:

(1) Since the supporting plate is rather large in area, the intensity of pressure on floor is relatively small. The force exerted by user during usage can not be transmitted to the floor effectively;

(2) Since the supporting plate is rather large in dimension, it is difficult to enter into narrow and ambiguous space for cleaning said space;

(3) The attachment mechanism for mop cloth is not sufficiently convenient and reliable.

There were many inventions attempted to solve aforementioned problems, for example, European patent EP1810662, whose publication date is Oct. 14, 2004, has disclosed a floor mop with both surfaces applicable for cleaning. The supporting plate of said mop is secured by means of magnetic attraction, and further includes a rotary attachment mechanism, consisted of a permanent magnet for fixing and holding the mop cloth, and a hinge joint for applying any one of mop cloths secured on either surface of supporting plate. During the cleaning work, the user can make use of the mop cloth made of different cleaning materials on its both sides and fixed on the supporting plate by reversing the supporting plate.

In addition, U.S. Pat. No. 4,114,223A, whose publication date is Sep. 19, 1978, Chinese patent CN2549888Y, whose publication date is May 14, 2003, and CN2678552Y, whose publication date is Feb. 16, 2005, have also disclosed a floor mop with a rotary supporting plate structure. The common features of the above solutions are as follows: The both sides of the base plate are able to come into contact with and clean the ground. The shift of the two cleaning surfaces is accomplished by reversing the base plate. However, this type of design has drawbacks of complex mechanism, uneasy shift of the two cleaning surfaces, unsecured joint between the mop cloth and the base, etc. Moreover, since the two cleaning surfaces are disposed on both sides of one base plate, their surface areas are the same, resulting in a relatively small cleaning intensity of pressure. Furthermore, the above solutions can not resolve the problem for cleaning a narrow space due to the large dimension of the base plate.

Moreover, U.S. Pat. No. 6,591,442B2, whose publication date is Jul. 15, 2003, has disclosed a floor mop base capable to be turned around. The lower layer of the mop base is made of a water-absorbent material, and the upper layer is made of plastics or other similar materials. The mop base has a configuration capable to be turned up to 90 degrees. Such configuration makes the mop base accommodate floor surfaces having different shapes for cleaning work. The mop cloth is secured on the mop base in a conventional manner. There are four holes for fixation of cloth on both sides of the upper portion of the mop base. The mop cloth is wrapped on the base and then the edges of cloth are inserted into the holes for fixation. This solution has provided two cleaning surfaces. The non-reversible main cleaning surface can accomplish the conventional floor cleaning work, while the reversible sub cleaning surface can form an angle of 90 degrees with respect to the main cleaning surface. When cleaning the edge portions, the user can clean the ground and the wall corner at the same time. However, in the above solution, only the non-reversible main cleaning surface is adopted to effectively clean the ground, the reversible sub-cleaning surface can not take effect unless the edge portions, such as the ground and the wall corner, are needed being cleaned. Therefore, the eventual effect is only to eliminate the dead areas during the cleaning operation, not to integrate different cleaning abilities.

International patent WO0243555A1, whose publication date is Jun. 6, 2002, has disclosed a cleaning device having an adhesive surface and a clean cloth surface. The main cleaning surface is incorporated with a conventional cleaning material, and the adhesive surface can wipe off some large-size particles, such as, dust and sand, etc. The shift of the two cleaning surfaces is accomplished by the stopper disposed on the cleaning device. When the angle between the supporting arm and the cleaning device is larger than a predetermined angle, the adhesive surface will come into contact with the ground due to principle of lever. However, when the adhesive surface comes into contact with the ground, the force applied by the user can not be transmitted to the positions to be cleaned effectively, that is, the cleaning work depends on the adhesive function of the sub cleaning surface. Therefore, in the above solution, the adhesive surface is only a supplement of the functions of the main cleaning surface, the material and functions of the sub cleaning surface will be limited.

Summing up, although the floor mop disclosed in the above referenced patents can be used at the same time for ordinary floor cleaning and for cleaning off stubborn stains, as well as for cleaning of ambiguous floor space having different shapes through reversing the edge structures, it still cannot overcome all the abovementioned drawbacks.

What is needed urgently at present is a cleaning device which has a simple structure and different cleaning abilities so that the user can shift the different cleaning abilities easily.

SUMMARY OF INVENTION

The object of the invention is to provide a cleaning device which has a simple structure and different cleaning abilities so that the user can shift the different cleaning abilities easily.

The cleaning device of the present invention comprises: a cleaning portion, the cleaning portion is provided with a cleaning surface and an opposite surface opposed to said cleaning surface; a supporting arm; and a pivoting mechanism for pivotably supporting the supporting arm on the opposite surface, wherein the cleaning surface of the cleaning portion includes a first cleaning material surface and a second cleaning material surface, the first cleaning material surface and the second cleaning material surface come into contact with the surfaces to be cleaned, respectively, when any one of the first cleaning material surface and the second cleaning material surface comes into contact with the surface to be cleaned, the other cleaning material surface has an angle from 90 degrees to 180 degrees with respect to the surface to be cleaned.

Preferably, the cleaning portion may be provided with a supporting plate, the first cleaning material surface and the second cleaning material surface may be disposed on the bottom surface or side surface of the supporting plate, respectively.

Preferably, the cleaning portion may be provided with a supporting plate and at least one side plate pivotably attached to one side of the supporting plate, the side plate may be provided with positioning elements at its distal edge, the supporting plate may be provided with position cooperation means for mating with the positioning elements, the side plate and the supporting plate may form an angle less than 90 degrees after fixation of the positioning elements and the position cooperation means, the first cleaning material surface and the second cleaning material surface may be disposed on the bottom surface of the supporting plate or side surface of the side plate, respectively.

Preferably, both of the positioning elements and the position cooperation means may be composed of a row of teeth having overlapped positions with the other row.

In another embodiment, the first cleaning material surface and the second cleaning material surface may be disposed on an integral structure, and may be fixed to predetermined positions of the supporting plate and the side plate by means of the integral structure, the positioning elements and the position cooperation means.

Preferably, the side plate may have a predetermined radian.

Optionally, the surface area of the first cleaning material surface may be larger than that of the second cleaning material surface, and the shape of the first cleaning material surface may be different from that of the second cleaning material surface.

In a further preferred embodiment, the first cleaning material surface and the second cleaning material surface may be replaceable, the first cleaning material surface and the second cleaning material surface may be separately replaceable.

In a further preferred embodiment, the cleaning material of the first cleaning material surface may be identical to or different from that of the second cleaning material surface. When the cleaning materials of the first and second cleaning material surfaces are different, the cleaning material of the first cleaning material surface may be a conventional cleaning material, such as, cotton thread, polyester fiber, superfine fiber, non-woven fabrics, etc., the cleaning material of the second cleaning material surface may be an abrasive material, such as, nylon non-woven fabrics or nylon fabrics having abrasive particles, etc., or a bibulous material, such as, superfine fiber, PVC, wood pulp sponge, etc.

The advantages of the cleaning device having multiple cleaning surfaces of the present invention are as follows:

1. During usage of the cleaning device, the supporting plate and the side plate having different cleaning materials can be respectively applied for cleaning ordinary floor or particular floor with stubborn stains;

2. During usage of the cleaning device, the supporting plate and the side plate with different dimensions can be respectively applied for cleaning ordinary space or narrow space;

3. The clamping method for mop cloth is convenient and reliable.

BRIEF DESCRIPTION OF APPENDED DRAWINGS

The construction and advantages of floor mop with multiple cleaning surfaces of present invention are further illustrated in detail with help of appended drawings and concrete embodiments in the following, in which.

DESCRIPTION OF PREFERRED EMBODIMENT

Preferred embodiments of the present invention will be described as follows with reference to the appended drawings, in which like reference numbers denote like elements.

The First Embodiment

Figure 1:
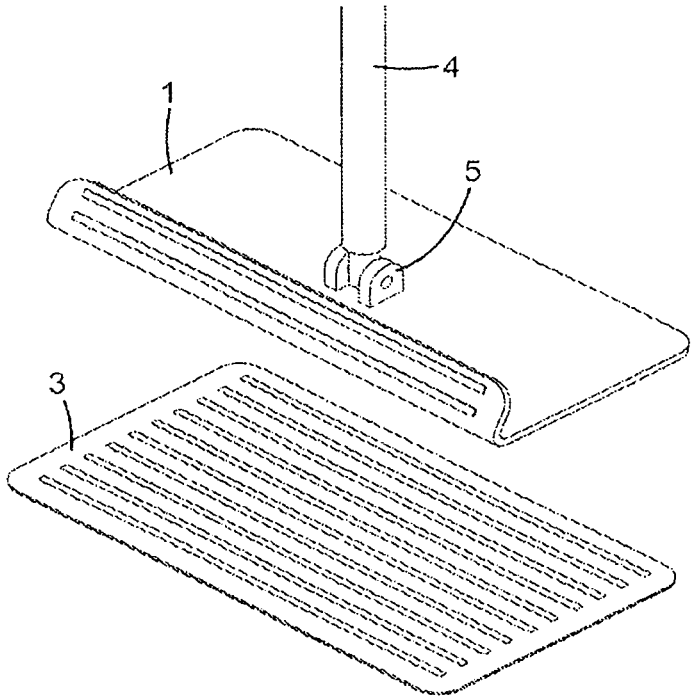
FIG. 1 is a perspective view of a first embodiment of a cleaning device having multiple cleaning surfaces according to the present invention.

FIG. 1 is a perspective view of the first embodiment of the cleaning device having multiple cleaning surfaces according to the present invention.

Refer to FIG. 1, the cleaning device has a cleaning portion, a supporting arm 4 and a pivoting mechanism 5. The cleaning portion has a cleaning surface 3 on its bottom surface, and an opposite surface opposed to the cleaning surface 3 on its top surface. The support arm 4 is pivotably supported on the opposite surface by means of the pivoting mechanism 5 mounted on the opposite surface, so as to freely rotate with respect to the cleaning portion.

The cleaning surface 3 of the cleaning portion includes a first cleaning material surface 3*a* and a second cleaning material surface 3*b*. As seen in FIG. 1, the cleaning portion has a supporting plate 1. The first cleaning material surface 3*a* is disposed on the bottom surface of the supporting plate 1, and the second cleaning material surface 3*b* is disposed on the side surface of the supporting plate 1. It can be seen from FIG. 1 that the first cleaning material surface 3*a* is disposed on a cleaning plate whose dimension is substantially identical to that of the bottom surface of the supporting plate 1, then is mounted to the bottom surface of the supporting plate 1. The second cleaning material surface 3*b* is directly disposed on the side surface of the supporting plate 1. However, it is well known to the skilled persons in the art that the first cleaning material surface 3*a* can be directly disposed on the bottom surface of the supporting plate 1, and the second cleaning material surface 3*b* can be disposed on another cleaning plate and then mounted to the side surface of the supporting plate 1. The above-mentioned variations will fall within the scope for which protection is sought in this invention.

Figure 2A:
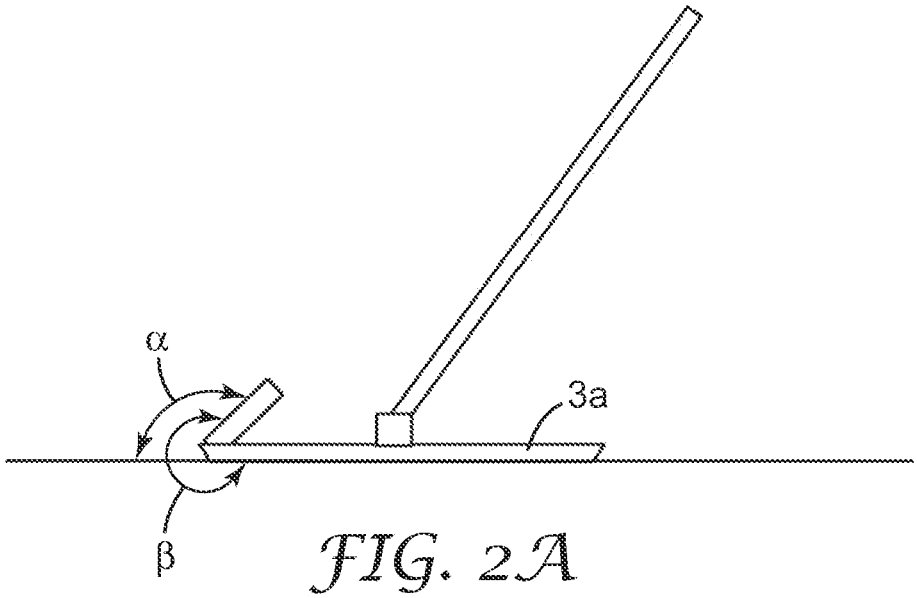
FIGS. 2A and 2B are the sketch views of the operational state of the cleaning device.
Figure 2B:
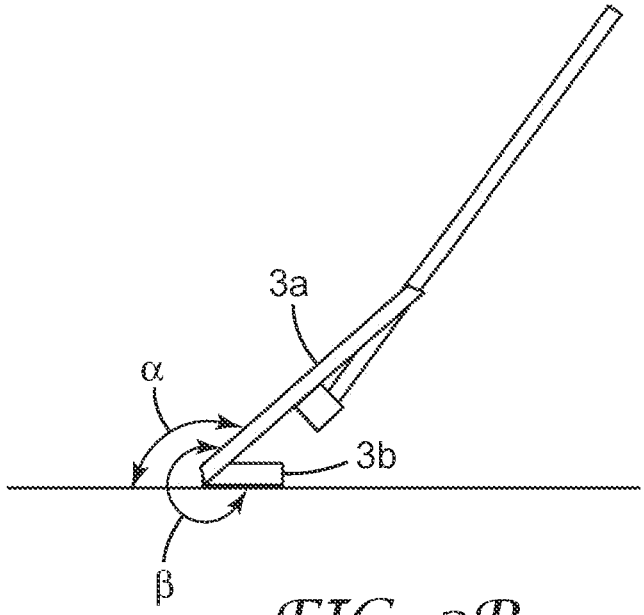

When the cleaning work is done, the first cleaning material surface 3*a* and the second cleaning material surface 3*b* come into contact with the surfaces to be cleaned, respectively. As seen in FIGS. 2A and 2B, the first cleaning material surface 3*a* and the second cleaning material surface 3*b* are designed to form an angle β larger than 270 degrees. That is, when the first cleaning material surface 3*a* comes into contact with the surface to be cleaned, the second cleaning material surface 3*b* has an angle larger than 90 degrees and smaller than 180 degrees with respect to the surface to be cleaned (Refer to FIG. 2A); when the second cleaning material surface 3*b* comes into contact with the surface to be cleaned, the first cleaning material surface 3*a* has an angle larger than 90 degrees and smaller than 180 degrees with respect to the surface to be cleaned (Refer to FIG. 2B). Thus, the operator can rotate the support arm 4 during the cleaning work so that the first cleaning material surface 3*a* and the second cleaning material surface 3*b* come into contact with the surfaces to be cleaned, respectively.

The Second Embodiment

Figure 3:
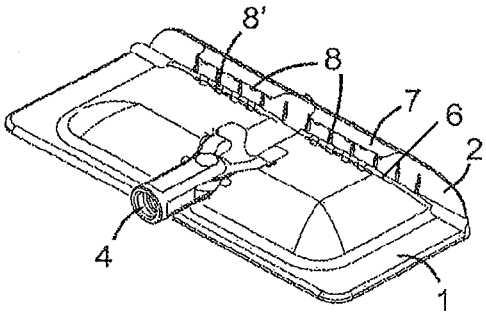
FIG. 3 is a perspective view of a second embodiment of a cleaning device having multiple cleaning surfaces according to the present invention, in which the side plate has not been snap-fitted to the inclined surface of the supporting plate.
Figure 4:
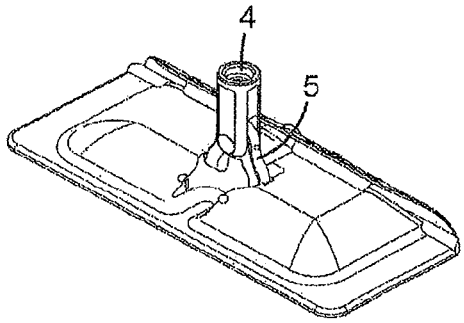
FIG. 4 shows a state where the side plate has been snap-fitted to the supporting plate of the cleaning device in FIG. 3.

Refer to FIGS. 3 and 4, they are the perspective views of a second embodiment of a cleaning device having multiple cleaning surfaces according to the present invention, in which the side plate 2 of the cleaning device in FIG. 3 has not been secured onto the supporting plate 1, while the side plate 2 of the cleaning device in FIG. 4 has already been secured onto the supporting plate 1.

The structures of the second embodiment are substantially identical to those of the first embodiment. Their distinctions mainly lie in that the cleaning portion of the first embodiment is composed of the supporting plate 1, while the cleaning portion of the second embodiment is composed of the supporting plate and at least one side plate 2 pivotably attached to one side of the supporting plate 1.

Refer to FIG. 3, the cleaning device has a cleaning portion, a supporting arm 4 and a pivoting mechanism 5. The cleaning portion has a cleaning surface on its bottom surface, and an opposite surface opposed to the cleaning surface on its top surface. The support arm 4 is pivotably supported on the opposite surface by means of the pivoting mechanism 5 mounted on the opposite surface, so as to freely rotate with respect to the cleaning portion.

In the present embodiment, the cleaning portion is composed of a supporting plate 1 and a side plate 2 pivotably attached to one side of the supporting plate 1. However, the skilled persons in the art can appreciate that the cleaning portion can be composed of a supporting plate 1 and at least one side plate 2 pivotably attached to one side of the supporting plate 1. For example, both sides of the supporting plate 1 can be equipped with one side plate 2, or every side of the supporting plate 1 can be equipped with one side plate 2. The above-mentioned variations will fall within the scope for which protection is sought in this invention.

Since the surface area of the side plate 2 is smaller than that of the supporting plate 1, the intensity of pressure applied from the side plate 2 to the surface to be cleaned is larger than that of pressure applied from the supporting plate 1. In addition, the side plate 2 has an arc shape which is slightly protruded outward as a whole. The radian of the arc is designed to precisely make the side plate 2 come into contact with the surface to be cleaned.

The cleaning surface of the cleaning portion includes a first cleaning material surface 3*a* and a second cleaning material surface 3*b*. In the present embodiment, the first cleaning material surface 3*a* and the second cleaning material surface 3*b* are disposed on an integral structure, i.e., a mop cloth 9. One end of the mop cloth 9 is secured on the supporting plate 1, and the other end of the mop cloth 9 is secured on to the side plate 2, so that the supporting plate 1 and the side plate 2 are wrapped therein.

Figure 5:
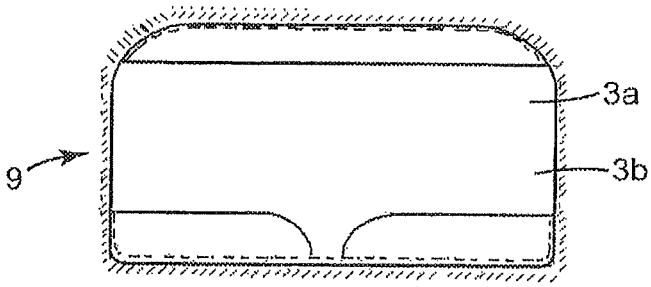
FIG. 5 is a plan view of the mop cloth wrapped on the cleaning device in FIG. 3.

Refer to FIG. 5, it is a plan view of the mop cloth 9. The mop cloth 9 has a rectangle shape. In order to mount the mop cloth 9 to the supporting plate 1 and the side plate 2 easily, a plurality of pockets may be sewn on the mop cloth 9. In addition, the corner portions of mop cloth 9 are tailored to conform to the shapes of supporting plate 1 and side plate 2, so that the mop cloth 9 is firmly fixed on the supporting plate 1 and the side plate 2.

Figure 6:
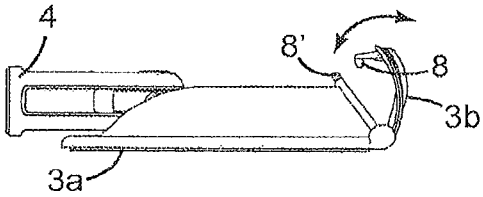
FIG. 6 is a sectional view of the cleaning device in FIG. 3.

As seen in FIGS. 5 and 6, the first cleaning material surface 3*a* is disposed on the position where corresponds to the supporting plate 1 on the mop cloth 9 and covers the bottom surface of the supporting plate 1, while the second cleaning material surface 3*b* is disposed on the position where corresponds to the side plate 2 on the mop cloth 9 and covers the bottom surface of the side plate 2. Since the surface area of the supporting plate 1 is larger than that of the side plate 2, the surface area of the first cleaning material surface 3*a* is also larger than that of the second cleaning material surface 3*b*. The cleaning materials of the first cleaning material surface 3*a* and the second cleaning material surface 3*b* can be the same or different. When the cleaning materials of the first and second cleaning material surfaces 3*a* and 3*b* are different, the cleaning material of the first cleaning material surface 3*a* is a conventional cleaning material, and the cleaning material of the second cleaning material surface 3*b* is an abrasive material or a bibulous material.

The conventional cleaning material includes cotton thread, polyester fiber, superfine fiber, non-woven fabrics, etc. The abrasive material includes nylon non-woven fabrics or nylon fabrics having abrasive particles, etc. The bibulous material includes superfine fiber, PVC, wood pulp sponge, etc.

As seen in FIG. 3, the supporting plate 1 has an inclined surface 6 on the side adjacent to the side plate 2. The lower portion of the inclined surface 6 is equipped with a pivot shaft, the side plate 2 can freely rotate about the lower portion of the inclined surface via the pivot shaft. When the side plate 2 is rotated to come into contact with the inclined surface 6, its distal edge, i.e., a movable edge which can free rotate with respect to the supporting plate 1, is just abutted against the inclined surface 6, so that the side plate 2 and the supporting plate 1 forms an angle β larger than 270 degrees. Two protrusion portions 7 are integrally formed on the distal edge of the side plate 2, and a plurality of positioning teeth 8 (It has five positioning teeth in the present embodiment) are disposed on each protrusion portion 7. A row of position cooperation teeth 8' are disposed on the top of the inclined surface 6 of the supporting plate 1, as seen in FIG. 3, the position cooperation teeth 8' are disposed on both sides of the supporting plate 1 along its central axis, and four teeth are formed on each side, but their positions are overlapped with the row of the positioning teeth 8 on the side plate 2. Therefore, after the distal edge of the side plate 2 is abutted against the top of the inclined surface 6, the positioning teeth 8 of the side plate 2 and the position cooperation teeth 8' of the supporting plate 1 can be firmly secured together if a slight force is applied. Of course, the skilled persons in the art shall understand that other fastening means, such as, a fastening ring, a buckle or a plug, etc., can also be employed, so that the side surface 2 and the supporting surface 1 form an angle β larger than 270 degrees. The above-mentioned fastening means shall also fall within the scope for which protection is sought in the present invention.

With the cleaning device having the above-mentioned structures, the user can make use of the supporting plate 1 with larger contact area and less cleaning pressure when cleaning ordinary floor. And the user can make use of the side plate 2 with less contact area and larger cleaning pressure when cleaning particular floor having stubborn stains, so that the force exerted by user is effectively transmitted to the floor, whereby stubborn stains are removed. In addition, when the side plate 2 is used, since the cleaning width becomes smaller, the cleaning device of the present invention can enter into a narrow space for its cleaning work. Since the mop cloth 9 wraps the edges of the supporting plate 1, the objects to be cleaned will not be injured or scraped by impact of the cleaning device when cleaning wall corners or furniture legs in the cleaning sites.

The method of using the cleaning device with multiple cleaning surfaces of the present invention will be described briefly with reference to FIGS. 6 and 7 as follows.

Figure 7:
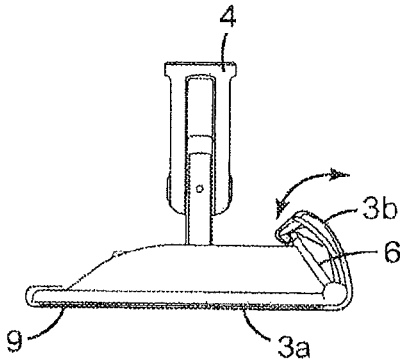
FIG. 7 is a sectional view of the cleaning device in FIG. 4.

As shown in FIGS. 6 and 7, the user first covers the mop cloth 9 with the supporting plate 1 and the side plate 2, and then pivots the side plate 2 anticlockwise. When the side plate 2 is rotated to a position where its distal edge is just abutted against the top of the inclined surface 6, a force is applied to the side plate 2 so that the positioning teeth 8 are snap-fitted into the cooperation teeth 8' of the supporting plate 1. Thus, the mop cloth 9 is firmly held between the two rows of teeth 8, 8'. During usage of the cleaning device, the user can make use of the supporting plate 1 when cleaning ordinary floor; and if a floor with stubborn stains or a narrow floor space shall be cleaned, the user can rotate the supporting arm 4, swing the supporting plate 1 upward and make the side plate 2 come into contact with the surface to be cleaned, so that the supporting plate 1 is replaced with the side plate 2 for cleaning the surface to be cleaned.

While the construction and effects of the cleaning device having multiple cleaning surfaces of the present invention has been described above with reference to the preferred embodiments, the skilled persons in the art will appreciate that examples cited above are only used for illustration, and are not to limit the scope of protection of present invention. Consequently, within the essential spirit and scope of appended Claims there may be many modifications and variations in present invention. For example, the first cleaning material surface and the second cleaning material surface can be integrally or separately replaceable; the shape of the first cleaning material surface can be different from that of the second cleaning material surface; and the number of the positioning teeth and the cooperation teeth can be varied, etc. All these modifications will fall within the scope of Claims appended in present invention.

We claim:

1. A cleaning device, comprising:

a cleaning portion having a cleaning surface and an opposite surface opposed to the cleaning surface;

a supporting arm; and a pivoting mechanism for pivotably supporting the supporting arm on the opposite surface, wherein the cleaning surface of the cleaning portion includes a first cleaning material surface and a second cleaning material surface, wherein the first cleaning material surface and the second cleaning material surface come into contact with the surfaces to be cleaned, wherein the cleaning portion is provided with a supporting plate and at least one side plate pivotably attached to one side of the supporting plate, the side plate comprising a moveable distal edge distal the one side of the supporting plate;

wherein the moveable distal edge comprises positioning elements for selectively fixing the moveable distal edge to the supporting plate in a fastened position;

wherein in the fastened position as one of the first cleaning material surface and the second cleaning material surface comes into contact with the surface to be cleaned, the other cleaning material surface has an angle from 90 degrees to 180 degrees with respect to the surface to be cleaned.

2. The cleaning device of claim 1, wherein:

the first cleaning material surface is disposed on the bottom surface of the supporting plate and the second cleaning material surface is disposed on the bottom surface of the side plate.

3. The cleaning device of claim 1, wherein:

wherein the supporting plate is provided with position cooperation elements for mating with the side plate moveable distal edge positioning elements, and wherein the side plate and the supporting plate form an angle (β) larger than 270 degrees after mating of the positioning elements and the position cooperation elements, the first cleaning material surface is disposed on the bottom surface of the supporting plate and the second cleaning material surface is disposed on the bottom surface of the side plate.

4. The cleaning device of claim 3, wherein:

the positioning elements and the position cooperation elements are composed of a row of teeth having overlapped positions with the other row.

5. The cleaning device of claim 3, wherein:

the first cleaning material surface and the second cleaning material surface are disposed on an integral structure, and are fixed to predetermined positions of the supporting plate and the side plate.

6. The cleaning device of claim 1, wherein:

the surface area of the first cleaning material surface is larger than the surface area of the second cleaning material surface.

7. The cleaning device of claim 1, wherein:

the shape of the first cleaning material surface is different from the shape of the second cleaning material surface.

8. The cleaning device of claim 1, wherein:

the first cleaning material surface and the second cleaning material surface are replaceable.

9. The cleaning device of claim 8, wherein:

the first cleaning material surface and the second cleaning material surface are separately replaceable.

10. The cleaning device of claim 1, wherein:

the cleaning material of the first cleaning material surface is the same material for the second cleaning material surface.

11. The cleaning device of claim 1, wherein:

the cleaning material of the first cleaning material surface is different from that of the second cleaning material surface.

12. The cleaning device of claim 1, wherein:

the cleaning material of the first cleaning material surface is a woven, knitted, or nonwoven cleaning cloth, and the cleaning material of the second cleaning material surface is a scouring or abrasive material.

* * * * *